US010526929B2

(12) United States Patent
Nair et al.

(10) Patent No.: US 10,526,929 B2
(45) Date of Patent: Jan. 7, 2020

(54) VALVE TRAIN FOR AN ENGINE

(71) Applicant: Progress Rail Locomotive Inc., LaGrange, IL (US)

(72) Inventors: Adarsh Gopinathan Nair, Darien, IL (US); Laura E. Rasmussen, Brookefield, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 76 days.

(21) Appl. No.: 15/271,319

(22) Filed: Sep. 21, 2016

(65) Prior Publication Data

US 2018/0080350 A1 Mar. 22, 2018

(51) Int. Cl.

| | |
|---|---|
| ***F01L 1/18*** | (2006.01) |
| ***F01L 1/26*** | (2006.01) |
| ***F01L 1/24*** | (2006.01) |
| *F01L 1/20* | (2006.01) |

(52) U.S. Cl.

CPC ..... *F01L 1/26* (2013.01); *F01L 1/181* (2013.01); *F01L 1/182* (2013.01); *F01L 1/2405* (2013.01); *F01L 1/2411* (2013.01); *F01L 1/20* (2013.01); *F01L 2001/2444* (2013.01); *F01L 2800/06* (2013.01)

(58) Field of Classification Search

CPC . F01L 1/26; F01L 1/181; F01L 1/2405; F01L 1/20; F01L 1/2411; F01L 2001/2444

USPC ..... 123/90.39, 90.43, 90.44, 90.41

See application file for complete search history.

(56) References Cited

U.S. PATENT DOCUMENTS

| | | | | |
|---|---|---|---|---|
| 6,237,553 | B1 | 5/2001 | Suzuki | |
| 6,659,056 | B2 | 12/2003 | Sweetland | |
| 8,006,661 | B2 | 8/2011 | Palumbo | |
| 8,210,144 | B2 * | 7/2012 | Langewisch | F01L 1/14 123/90.22 |
| 2015/0354418 | A1 | 12/2015 | Jo et al. | |

FOREIGN PATENT DOCUMENTS

| | | |
|---|---|---|
| JP | 2008240632 | 10/2008 |
| WO | 2006132580 | 12/2006 |

* cited by examiner

*Primary Examiner* — Ching Chang

(74) *Attorney, Agent, or Firm* — Miller, Matthias & Hull

(57) ABSTRACT

A valvetrain for an engine includes a pair of valves that are disposed in a spaced apart relation to one another, and in which each of the valves has an elongated valve stem. The valvetrain further includes a valve bridge that is coupled to the pair of valves. The valve bridge is configured to define a pair of receptacles to at least partly receive the pair of valve stems therein. The valve bridge further defines a central recess that is located midway between the pair of receptacles and disposed in a co-planar relationship with the pair of receptacles.

13 Claims, 7 Drawing Sheets

VALVE TRAIN FOR AN ENGINE

TECHNICAL FIELD

The present disclosure relates to a valve train for an engine. More particularly, the present disclosure relates to a valve bridge arrangement for a valve train of an engine.

BACKGROUND

Many internal combustion engines have been known to use at least a pair of valves for either delivering fuel-air charge into a cylinder or for allowing products of combustion to exit from the cylinder upon combustion of the fuel-air charge. As these pair of valves serve to act as inlet or exhaust valves for a given cylinder of a given engine, such engines may typically also employ a valve bridge for transmitting actuation forces from a rocker arm to the pair of valves for accomplishing an opening or closing of the pair of valves.

U.S. Pat. No. 6,237,553 discloses a valve drive arrangement for use in an engine having a pair of intake valves and a pair of exhaust valves for each cylinder. Each pair of intake valves are coupled to each other by a valve bridge and forced downwards simultaneously by a single rocker arm, and each pair of exhaust valves are coupled to each other by another valve bridge and forced downwards simultaneously by another single rocker arm. A contact member is rotatably provided on an upper surface of each valve bridge such that it contacts the associated rocker arm. The press center of the rocker arm to the associated contact member and center lines of the associated valves lie in a single plane. Moreover, a rotation center of the associated contact member is offset from this single plane in which the press center of the rocker arm and the center lines of the associated valves lie.

SUMMARY OF THE DISCLOSURE

In an aspect of the present disclosure, a valvetrain for an engine includes a pair of valves that are disposed in a spaced apart relation to one another, and in which each of the valves has an elongated valve stem. The valvetrain further includes a valve bridge that is coupled to the pair of valves. The valve bridge is configured to define a pair of receptacles to at least partly receive the pair of valve stems therein. The valve bridge further defines a central recess that is located midway between the pair of receptacles and disposed in a co-planar relationship with the pair of receptacles.

Additionally, the valvetrain further includes a rocker arm that is rotatably supported on a rocker shaft and disposed away from the central recess of the valve bridge. The rocker arm may be configured to have a contact element depending downwardly from an end of the rocker arm. In an embodiment, the contact element may be an elephant foot button that is configured to be adjustably supported by the rocker arm.

Additionally, the valvetrain may further include a hydraulic lash adjuster that is slidably received in the central recess of the valve bridge. The hydraulic lash adjuster has a first end that is adapted to abut with a counterbored face of the valve bridge, the counterbored face being located adjacent to the central recess. The hydraulic lash adjuster also has a second end that is adapted to operatively abut with the contact element of the rocker arm.

The positioning of the central recess midway between the pair of receptacles facilitates an axial abutment of the contact element with the second end of the hydraulic lash adjuster such that the valve bridge is configured to simultaneously transmit an equal amount of actuating force from the rocker arm to each of the valves via the axially aligned contact element and the hydraulic lash adjuster if present, when the rocker arm operatively executes oscillatory motion about the rocker shaft.

Further, the co-planar relationship of the central recess with the pair of receptacles facilitates reciprocal movement of the valve bridge in a longitudinal plane included by the central recess and the pair of receptacles when the rocker arm operatively executes oscillatory motion about the rocker shaft. Furthermore, the co-planar relationship of the central recess with the pair of receptacles is further configured to operatively prevent the valve bridge from tilting and yawing out of the longitudinal plane.

Although the present disclosure is explained in conjunction with the contact element and the hydraulic lash adjuster, it may be noted that in another aspect of this disclosure, embodiments disclosed herein can be similarly realized without the presence of one or both of the contact element and the hydraulic lash adjuster. In such embodiments, one or both of the rocker arm and the valve bridge may be designed such that the rocker arm and the valve bridge may mutually co-operate with one another vis-à-vis the central recess of the valve bridge and accomplish functions that are consistent with the present disclosure i.e., in lieu of the contact element and the hydraulic lash adjuster disclosed herein.

In an embodiment, the contact element may define a first oil passage therethrough. The first oil passage has an outlet located at an end of the contact element that is disposed in abutment with the second end of the hydraulic lash adjuster. Additionally, the hydraulic lash adjuster may define a second oil passage therein. The second oil passage has an inlet defined at the second end of the hydraulic lash adjuster. The positioning of the central recess midway between the pair of receptacles and the co-planar relationship of the central recess midway with the pair of receptacles together facilitate an axial alignment between the outlet of the first oil passage and the inlet of the second oil passage from respective ones of the contact element and the hydraulic lash adjuster.

In another aspect, embodiments of this disclosure are also directed to a valve bridge for a valve train having a pair of valves that are disposed in a spaced apart relation to one another, and a rocker arm that is rotatably supported on a rocker shaft and being disposed away from the valve bridge. The rocker arm is configured to execute oscillatory motion about the rocker shaft for actuating the pair of valves via the valve bridge. The valve bridge defines a pair of receptacles configured to at least partly receive a pair of valve stems therein, the pair of valve stems being associated with the pair of valves. The valve bridge also defines a central recess that is located midway between the pair of receptacles and disposed in a co-planar relationship with the pair of receptacles.

Other features and aspects of this disclosure will be apparent from the following description and the accompanying drawings.

DETAILED DESCRIPTION

Figure 1:
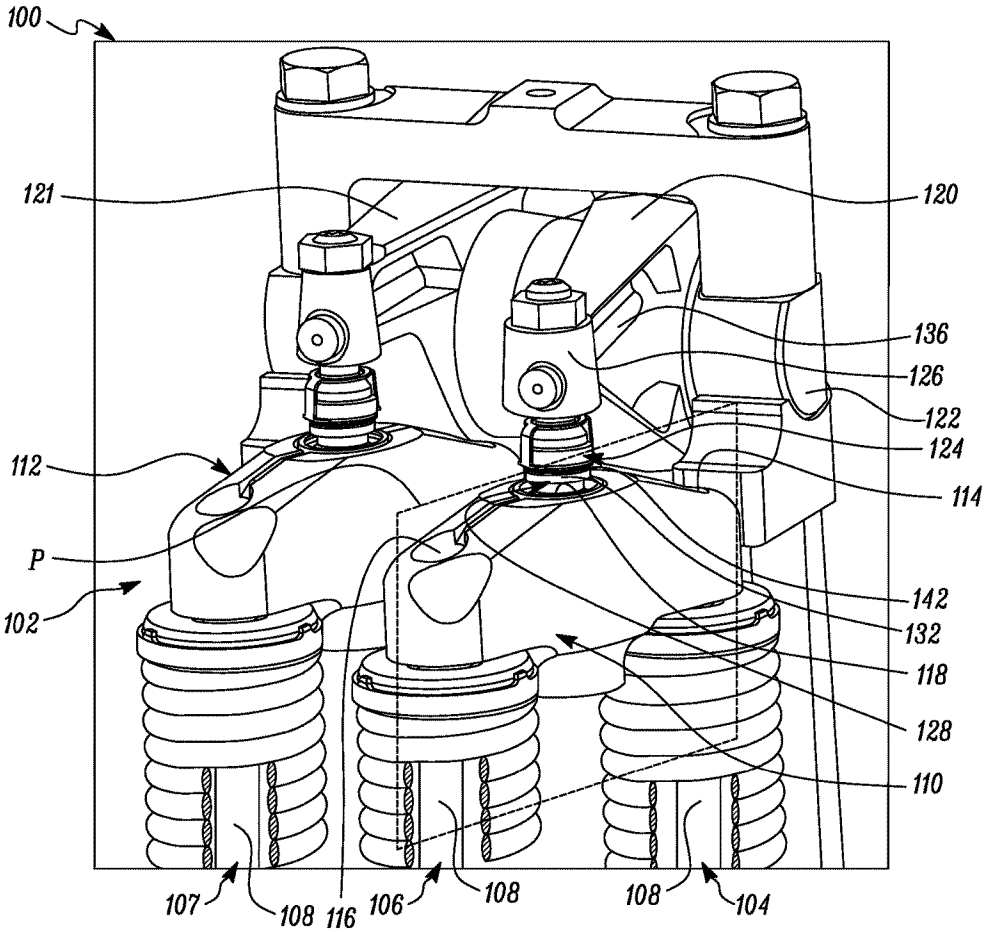
FIG. 1 is a fragmentary perspective view of an engine employing a valve train, in accordance with embodiments of the present disclosure.

Referring to FIG. 1, a fragmented perspective view of an engine 100 is illustrated in accordance with embodiments of this disclosure. The engine 100 disclosed herein may be embodied as a four stroke single cylinder engine. In an alternative embodiment, the engine 100 may be a multi-cylinder engine. It may be noted although that embodiments of the present disclosure are described in conjunction with the single cylinder engine 100, such embodiments may be similarly applied to multi-cylinder engine configurations including, but not limited to, an in-line configuration, a V-configuration, or a radial configuration.

Moreover, in other embodiments of this disclosure, the engine 100 disclosed herein may be alternatively embodied as a two stroke engine in lieu of the four stroke engine disclosed herein. Further, the engine 100 may be embodied as one of a spark ignition engine or a compression ignition engine. It should be noted that a type of fuel used is merely exemplary and hence, non-limiting of this disclosure. Persons skilled in the art will acknowledge that any suitable type of fuel may be used depending upon the type of engine 100 used and other specific requirements of an application.

In the illustrated embodiment of FIG. 1, the engine 100 is embodied as an overhead valve (OHV) engine. The engine 100 includes a valvetrain 102, explanation to which will be made in the appended disclosure.

Figure 2:
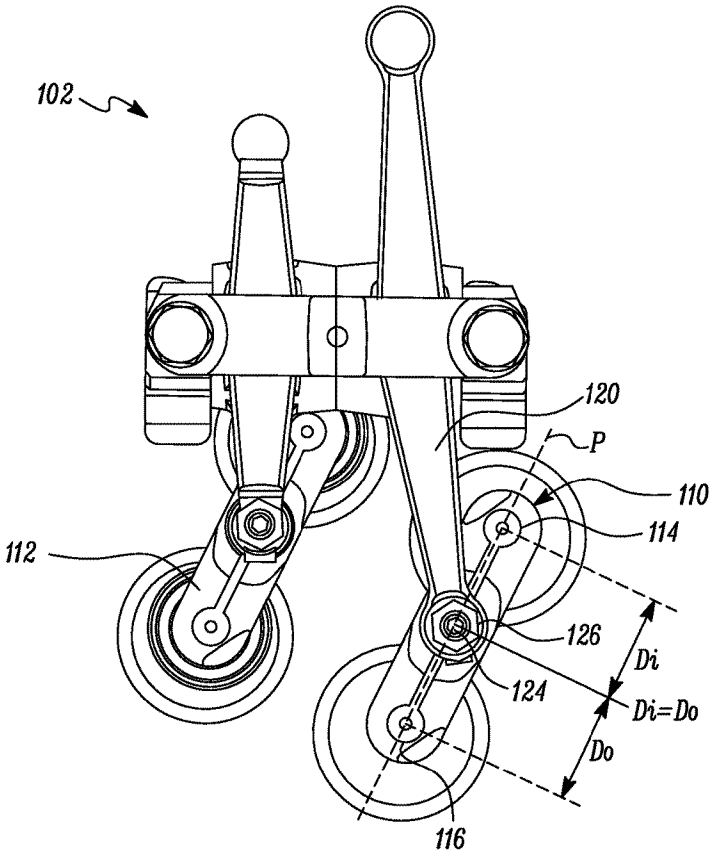
FIG. 2 is a fragmentary top view of the engine showing a pair of rocker arms at an instant prior to a valve event, in accordance with embodiments of the present disclosure.
Figure 4:
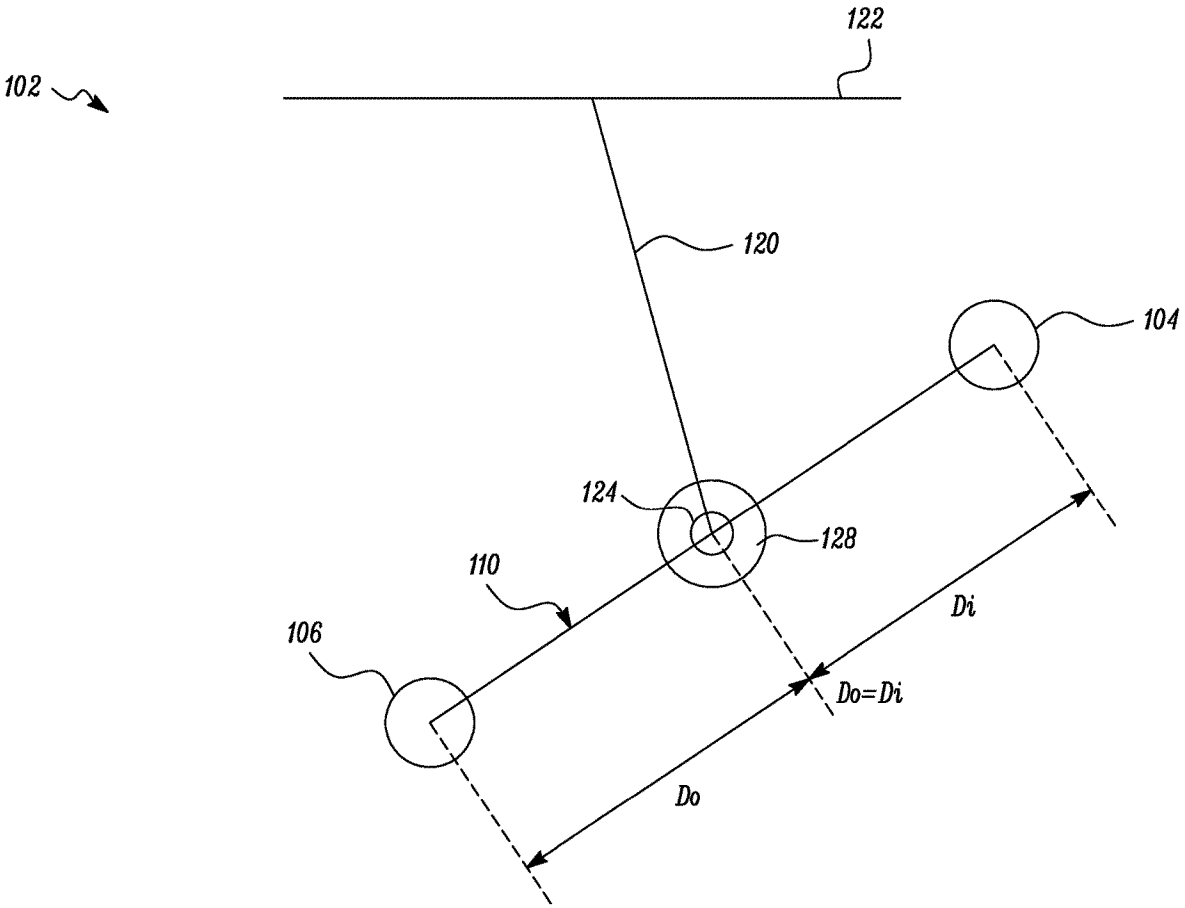
FIG. 4 is a stick diagram of the valve train at an instant prior to a valve event, in accordance with embodiments of the present disclosure.
Figure 5:
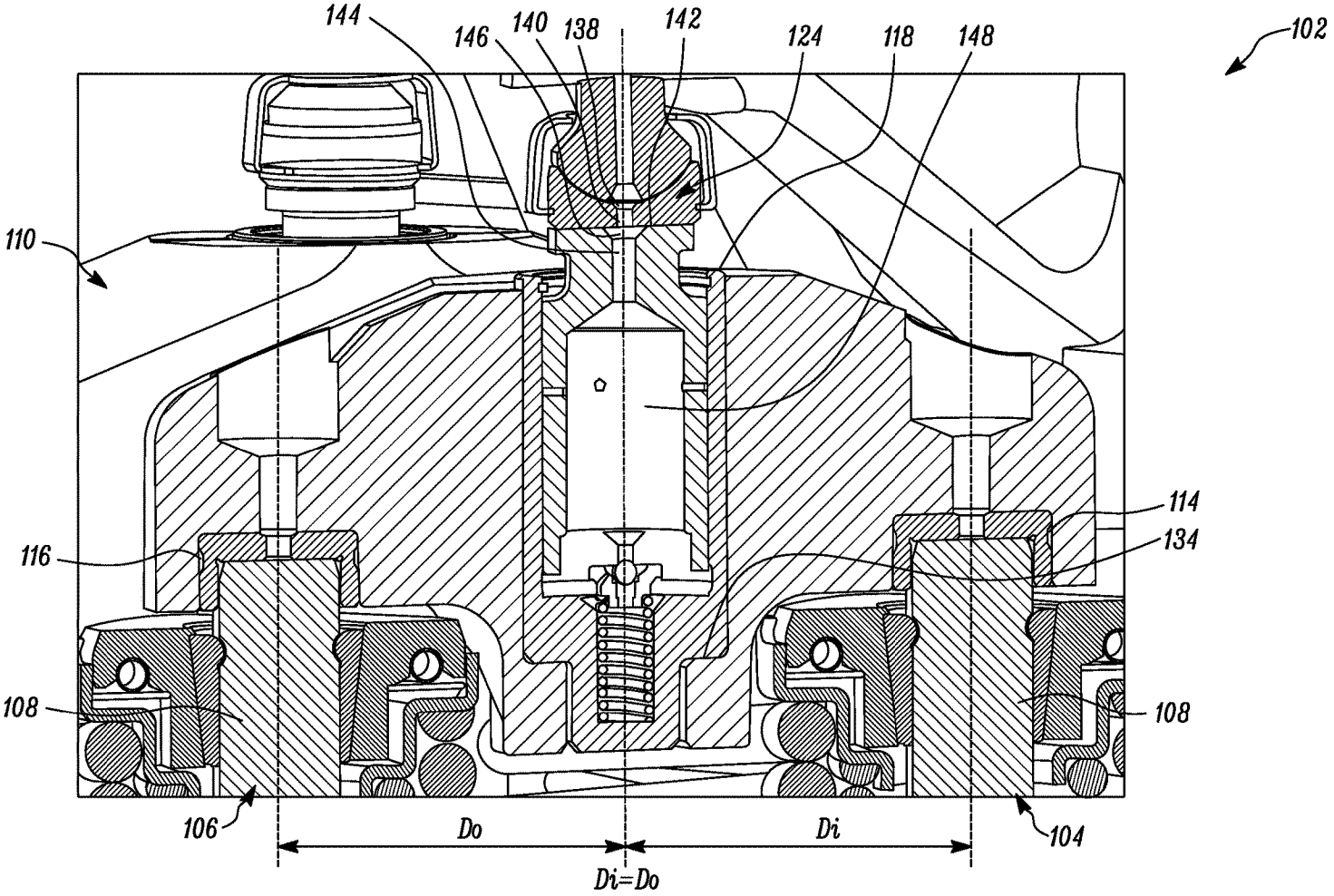
FIG. 5 is a fragmented sectional view of the engine showing an orientation of components present in the valve train at an instant prior to a valve event, in accordance with embodiments of the present disclosure.

Referring to FIGS. 1, 2 and 5, the valvetrain 102 includes a pair of inlet valves 104, 106 (as best shown in FIGS. 1, 4 and 5) and a pair of exhaust valves 105, 107 corresponding to the single cylinder (not shown) of the engine 100. Although embodiments of the present disclosure are explained in conjunction with the pair of inlet valves 104, 106, it may be noted that embodiments disclosed herein can be similarly applied to the pair of exhaust valves 105, 107 present on the engine 100. As such, the pair of inlet valves 104, 106 are configured to deliver fuel-air charge into the cylinder while the pair of exhaust valves 105, 107 are configured to allow products of combustion to exit from the cylinder. As shown, the pair of inlet valves 104, 106 may include an inboard valve and an outboard valve which are denoted by identical numerals '104' and '106' respectively. The inboard and outboard valves 104, 106 are disposed in a spaced-apart relation to one another. As shown, each of the inboard and outboard valves 104, 106 has an elongated valve stem 108.

Referring to FIGS. 1-3 and 5, the valvetrain 102 further includes a valve bridge 110 that is coupled to each of the inboard and outboard valves 104, 106. As shown best in FIG. 2, another valve bridge 112 may also be provided to similarly couple with the inboard and outboard valves 105, 107 from the pair of exhaust valves 105, 107 provided on the engine 100. For the sake of convenience and simplicity, explanation pertaining to embodiments of this disclosure is provided in conjunction with the valve bridge 110 that is associated with the inboard and outboard valves from the pair of inlet valves 104, 106 (shown in FIG. 5) of the engine 100. However, it should be noted that such embodiments can be similarly applied to the valve bridge 112 associated with the pair of exhaust valves 105, 107.

Figure 3:
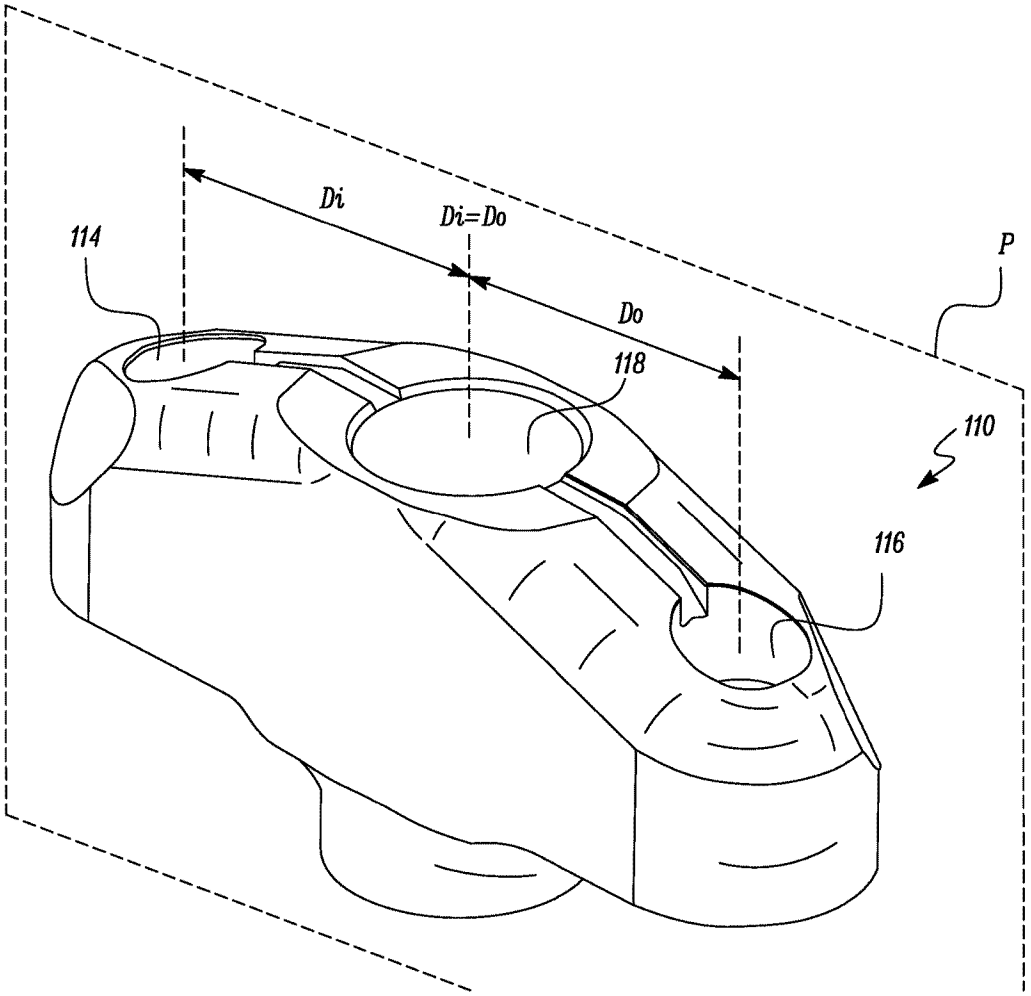
FIG. 3 is a perspective view of a valve bridge employed by the engine of FIG. 1, in accordance with embodiments of the present disclosure.

Referring to FIG. 3, the valve bridge 110 is configured to define a pair of receptacles 114, 116. As shown in FIG. 5, the pair of receptacles 114, 116 are adapted to at least partly receive the pair of valve stems 108 therein and establish an axially adjustable coupling between the valve bridge 110 and corresponding ones of the valves 104, 106. The valve bridge 110 further defines a central recess 118 (as best shown in FIGS. 1, 3 and 5) that is located midway between the pair of receptacles 114, 116. Each of the receptacles 114, 116 is therefore located equidistantly from the central recess 118. Further, in embodiments of this disclosure, the central recess 118 is also disposed in a co-planar relationship with the pair of receptacles 114, 116.

With reference to FIGS. 1, 2 and 5, the valvetrain 102 also includes a rocker arm, in particular, an intake rocker arm 120 that is associated with the pair of inlet valves 104, 106. For the sake of simplicity, the intake rocker arm 120 is hereinafter referred to as 'the rocker arm' and designated with identical numeral '120'. The rocker arm 120 is rotatably supported on a rocker shaft 122 and disposed away from the central recess 118 of the valve bridge 110. Another rocker arm 121 may be additionally provided on the rocker shaft 122 and associated with the valve bridge 112 corresponding to the pair of exhaust valves 105, 107. The rocker arm 120 is configured to have a contact element 124 depending downwardly from an end 126 of the rocker arm 120. In an embodiment as shown in FIGS. 1 and 5, the contact element 124 may be embodied in the form of an elephant foot button that is configured to be adjustably supported by the rocker arm 120. However, in other embodiments, other types of structures known in the art may be suitably configured and used in lieu of the elephant foot button disclosed herein.

Additionally, referring to FIGS. 1, 2 and 5, the valvetrain 102 further includes a hydraulic lash adjuster 128 that is slidably received in the central recess 118 of the valve bridge 110. The hydraulic lash adjuster 128 has a first end 130 that is adapted to abut with a counterbored face 134 of the valve bridge 110 located adjacent to the central recess 118, and a second end 132 that is adapted to operatively abut with the contact element 124 of the rocker arm 120.

Although the present disclosure is explained in conjunction with the contact element 124 and the hydraulic lash adjuster 128, it may be noted that in another aspect of this disclosure, embodiments disclosed herein can be similarly realized without the presence of one or both of the contact element 124 and the hydraulic lash adjuster 128. In such embodiments, one or both of the rocker arm 120 and the valve bridge 110 may be designed such that the rocker arm 120 and the valve bridge 110 may mutually co-operate with one another vis-à-vis the central recess 118 of the valve bridge 110 and accomplish functions that are consistent with the present disclosure i.e., in lieu of the contact element 124 and the hydraulic lash adjuster 128 disclosed herein.

In embodiments of this disclosure, the positioning of the central recess 118 midway between the pair of receptacles 114, 116 facilitates an axial abutment of the contact element 124 with the second end 132 of the hydraulic lash adjuster 128 such that the valve bridge 110 is configured to simultaneously transmit an equal amount of actuating force from the rocker arm 120 to each of the inboard and outboard valves 104, 106 via the axially aligned contact element 124 and the hydraulic lash adjuster 128 when the rocker arm 120 operatively executes oscillatory motion about the rocker shaft 122.

Further, referring to FIGS. 1, 3 and 5, the co-planar relationship of the central recess 118 with the pair of receptacles 114, 116 facilitates reciprocal movement of the valve bridge 110 in a longitudinal plane P that is included by the central recess 118 and the pair of receptacles 114, 116 when the rocker arm 120 operatively executes oscillatory motion about the rocker shaft 122. Furthermore, the co-planar relationship of the central recess 118 with the pair of receptacles 114, 116 is also configured to operatively prevent the valve bridge 110 from tilting and yawing out of the longitudinal plane P.

Referring to FIG. 1, the rocker arm 120 is configured to define an oil feed line 136 extending within a volume of the rocker arm 120. Moreover, the oil feed line 136 has an outlet (not shown) disposed in fluid communication with the end 126 of the rocker arm 120 that is configured to support the contact element 124 therein. Further, as shown in FIG. 5, the contact element 124 may be adapted to define a first oil passage 138 therethrough. Referring to FIGS. 1 and 5, the first oil passage 138 may be disposed in fluid communication with the oil feed line 136 associated with the rocker arm 120. The first oil passage 138 has an outlet 140 located at an end 142 of the contact element 124 that is disposed in abutment with the second end 132 of the hydraulic lash adjuster 128.

Additionally, as shown in FIG. 5, the hydraulic lash adjuster 128 is adapted to define a second oil passage 144 therein. The second oil passage 144 has an inlet defined at the second end 132 of the hydraulic lash adjuster 128. Referring to FIGS. 1, 2, 3 and 5, the positioning of the central recess 118 midway between the pair of receptacles 114, 116 together with the co-planar relationship of the central recess 118 with the pair of receptacles 114, 116 also facilitates an axial alignment between the outlet 140 of the first oil passage 138 and the inlet 146 of the second oil passage 144 from respective ones of the contact element 124 and the hydraulic lash adjuster 128. This way, a plunger 148 (shown in FIG. 5) provided in the hydraulic lash adjuster 128 can be provided with the required amount of oil when the pair of valves 104, 106 undergo a dwell phase e.g., when a base circle of a cam element (not shown) is in contact with a follower element (not shown) for preventing any oscillatory movement of the rocker arm 120 about the rocker shaft 122 and maintaining the pair of valves 104, 106 in their respective closed positions.

With reference to FIG. 4, a distance $D_i$ between the inboard valve 104 and the hydraulic lash adjuster 128 is maintained equal to a distance $D_o$ between the outboard valve 106 and the hydraulic lash adjuster 128. The equidistant positioning of the inboard and outboard valves 104, 106 with respect to the hydraulic lash adjuster 128 causes an equal moment arm to exist between respective ones of the valves 104, 106 and the hydraulic lash adjuster 128.

Moreover, it is also known in the art that during operation of the engine 100, one or more external forces may act on each of the inlet valves 104, 106 i.e., the inboard inlet valve 104 and the outboard inlet valve 106 from fuel air charge combustion and the resulting cylinder pressure in addition to the valve spring forces. It is hereby envisioned that the equidistant positioning of the inboard and outboard valves 104, 106 with respect to the contact element 124 may help to reduce a differential in the amount of forces transmitted to each of the valves 104, 106 for opening and closing respective ones of the valves 104, 106 against the external forces mentioned above. Consequently, the differential in valve lift associated with each of the valves 104, 106 with respect to one another is reduced when the rocker arm 120 transmits actuating force to the valve bridge 110 via the contact element 124 and the hydraulic lash adjuster 128 for opening and closing of the valves 104, 106. If the contact element 124 were not to be equidistantly positioned with respect to the inboard and outboard valves 104 and 106, forces may be distributed unequally to both the valves 104 and 106 and give rise to a moment balance. Consequently the differential in valve lift between respective ones of the valves 104 and 106 would be higher. In the case of exhaust valves 105 and 107, this condition could result in the exhaust valves 105, 107 encountering different cylinder pressures further worsening force distribution between the inboard and outboard exhaust valves 105 and 107 respectively and the subsequent opening of the valves 105 and 107.

Moreover, with the equidistant positioning of the inboard and outboard valves 104, 106 with respect to the contact element 124, the differential in the lifting of each valve i.e., the inboard valve 104 and the outboard valve 106 with respect to one another is minimized. This means, there would be little or no delay between the opening and closing of the respective ones of the valves 104, 106 in relation to one another. Such equidistant positioning when implemented on the pair of inlet valves 104, 106 with the help of the corresponding valve bridge 110 can therefore assist in facilitating at least an almost equal and simultaneous valve lift to each of the inlet valves 104, 106. The almost equal and simultaneous valve lift associated with the pair of inlet valves 104, 106 can beneficially cause an improvement in various operating conditions of the engine 100 such as, but not limited to, an improved swirl pattern of fuel-air charge in the cylinder, a shorter inter-mixing time of the fuel-air charge in the cylinder, an improved ignitability of the fuel-air charge in the cylinder, and an improved control in the emissions e.g., nitrous oxide ($NO_x$) of the engine 100.

Similarly, embodiments of this disclosure when implemented on the pair of exhaust valves 105 and 107 can help distribute actuation forces equally to respective ones of the exhaust valves 105 and 107. Although each of the exhaust valves 105 and 107 may encounter different cylinder pressures and valve spring pressures during operation of the engine 100, the equidistant positioning of the pair of the exhaust valves 105 and 107 from its corresponding contact element could help distribute forces uniformly between the inboard and outboard exhaust valves 105 and 107 respectively and therefore, improve the subsequent opening of the valves 105 and 107.

With continued reference to FIGS. 3 and 4, as the pair of receptacles 114, 116 and the central recess 118 are disposed co-planar to one another i.e., the pair of receptacles 114, 116 and the central recess 118 are disposed in the same longitudinal plane P, during an operation of the valvetrain 102, the actuating forces from the rocker arm 120 to the valve bridge 110 via the contact element 124 and the hydraulic valve adjuster 128 are configured to cause movement of the valve bridge 110 along the longitudinal plane P alone. This way, the valve bridge 110 is also prevented from being tilted or yawed out of the longitudinal plane P. A possibility of the valve bridge 110 coming into lateral and/or angular contact with the valve stems 108 of respective ones of the valves 104, 106 is therefore, minimized and the valve bridge 110 may not bias the valves 104, 106 for movement in planes other than the longitudinal plane P disclosed herein. As a result, various detrimental effects such as, but not limited to, galling of the valve stems 108 and/or the valve bridge 110 at the point of lateral and/or angular contact, and subsequent deterioration and/or failure of the valve stems 108 and/or the valve bridge 110 that would otherwise arise from the lateral and/or angular contact of the valve bridge 110 with the valve stems 108 of respective ones of the valves 104, 106 can be eliminated.

Figure 6:
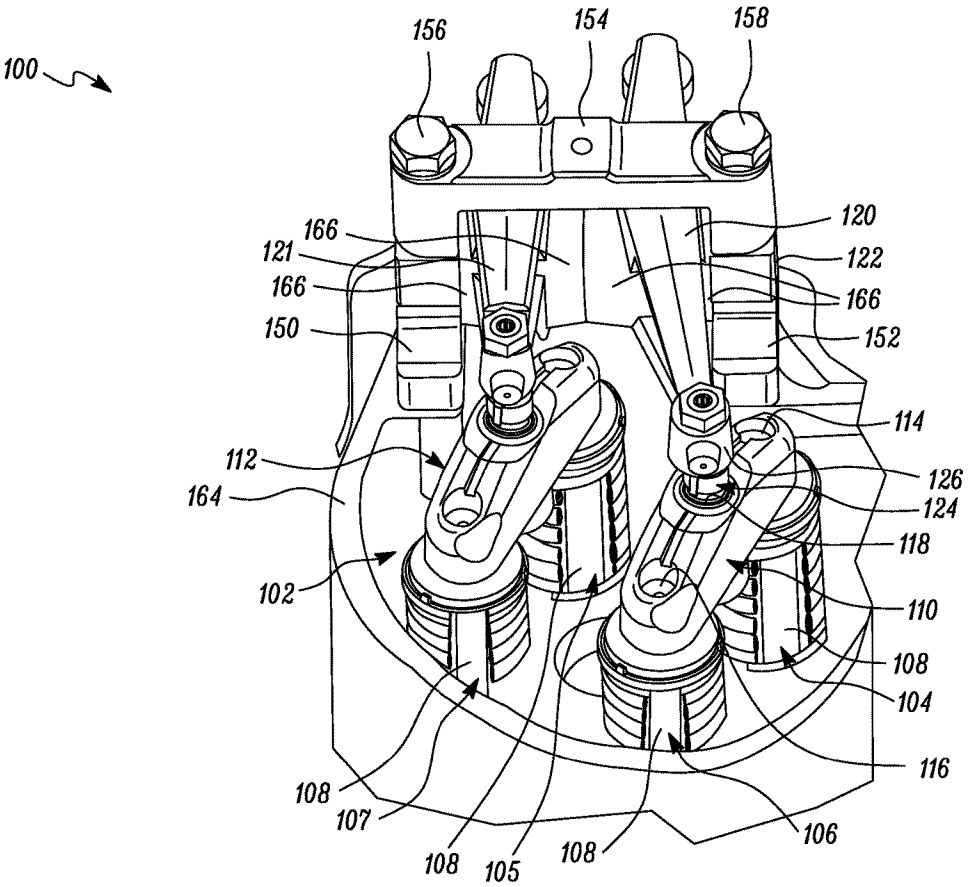
FIG. 6 is a top perspective view of the valve train employed by the engine of FIG. 1, in accordance with embodiments of the present disclosure.
Figure 7:
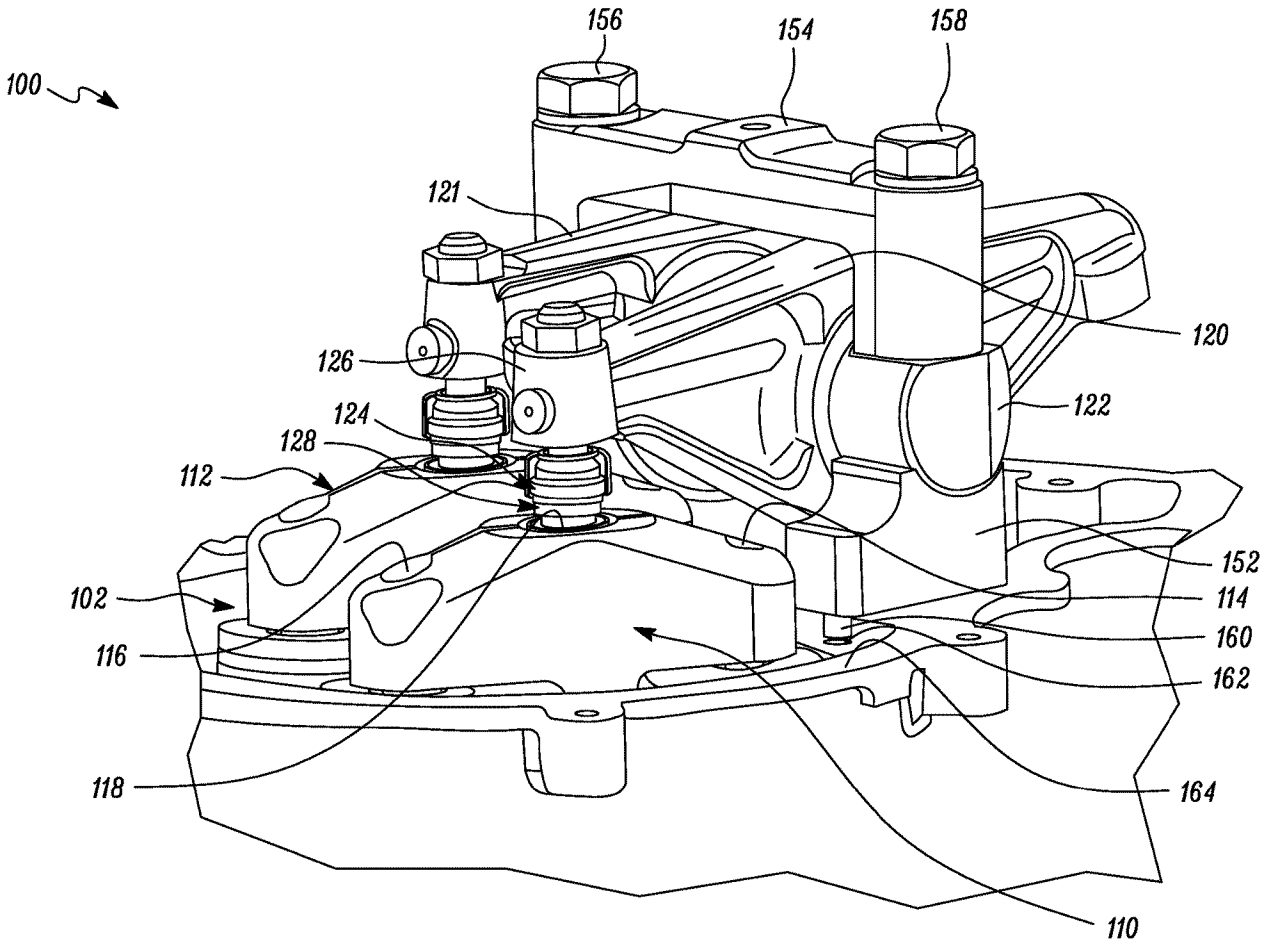
FIG. 7 is a side perspective view of the valve train employed by the engine of FIG. 1, in accordance with embodiments of the present disclosure.

Referring to FIGS. 6 and 7, in another aspect of this disclosure, the valvetrain 102 disclosed herein includes a pair of support blocks 150, 152 that are configured to rotatably bear the rocker shaft 122 thereon. As shown, the rocker shaft 122 rotatably supports the pair of rocker arms 120, 121 to allow each of the rocker arms 120, 121 to independently execute oscillatory motion about the rocker shaft 122 based on the respective timing arrangements designated to each of the rocker arms 120, 121. Further, the rocker shaft 122 is also held in position by a clamp 154 using a pair of fasteners 156, 158. The fasteners 156, 158 disclosed herein are embodied in the form of HEX bolts. However, in alternative embodiments, other types of fasteners including, but not limited to, Allen screws, grub screws, and the like can be used in lieu of the HEX bolts disclosed herein.

Each of the support blocks 150, 152 contain one or more dowel pins 160 that are disposed in mutual alignment with corresponding ones of receptacles 162 defined on a base 164 for e.g., a rocker box of the engine 100. Each of the dowel pins 160 and their corresponding receptacles 162 are machined to close tolerances so that there is little or no play in the movement of the individual rocker arms 120, 121 when each of the rocker arms 120, 121 executes an oscillatory motion about the rocker shaft 122.

Also, as best shown in FIG. 6, each of the rocker arms 120, 121 is designed to further include an extension 166. A configuration i.e., size and shape of the extension 166 on the rocker arm 120 is selected so as to assist the rocker arm 120 in advantageously maintaining its contact element 124 in axial alignment with the hydraulic lash adjuster 128 when the contact element 124 abuts the hydraulic lash adjuster 128 during operation of the valvetrain 102. Consequently, the differential in valve lift associated with each of the valves 104, 106 with respect to one another is reduced when the rocker arm 120 transmits actuating force to the valve bridge 110 via the contact element 124 and the hydraulic lash adjuster 128 for opening and closing of the valves 104, 106. Moreover, with the help of the extension 166 provided on the rocker arm 120, the first oil passage 138 of the contact element 124 can be easily brought into alignment with the second oil passage 144 of the hydraulic lash adjuster 128 as shown in FIG. 5.

Similarly, a configuration i.e., size and shape of the extension 166 on the rocker arm 121 is also selected so as to assist the rocker arm 121 in maintaining its contact element in axial alignment with the corresponding hydraulic lash adjuster when the contact element abuts the hydraulic lash adjuster during operation of the valvetrain 102. As a result, the differential in valve lift associated with each of the valves 105, 107 with respect to one another is reduced when the rocker arm 121 transmits actuating force to the valve bridge 112 via its associated contact element and the corresponding hydraulic lash adjuster for opening and closing of the valves 105, 107.

Various embodiments disclosed herein are to be taken in the illustrative and explanatory sense, and should in no way be construed as limiting of the present disclosure. All joinder references (e.g., attached, affixed, coupled, engaged, connected, and the like) are only used to aid the reader's understanding of the present disclosure, and may not create limitations, particularly as to the position, orientation, or use of the components and/or structures disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", or any other ordinary and/or numerical terms, should also be taken only as identifiers, to assist the reader's understanding of the various elements of the present disclosure, and may not create any limitations, particularly as to the order, or preference, of any element relative to, or over, another element.

INDUSTRIAL APPLICABILITY

Embodiments of the present disclosure have applicability for use and implementation in facilitating an equal valve lift, and a simultaneous actuation for a pair of valves, for example, a pair of inlet valves or a pair of exhaust valves of an engine.

Many previously known designs of valve bridges may be inadvertently configured to establish two or more degrees of freedom for a pair of valves that are on the same timing arrangement, for example, a pair of inboard and outboard inlet valves, or a pair of inboard and outboard exhaust valves. With implementation of embodiments disclosed herein, manufacturers of valvetrains can potentially minimize the risk of damage, deterioration in performance and/or failure of the valves, the valve bridge, and/or other components of the valvetrain during an operation of the engine. Also, costs, time, and effort previously incurred with repair and/or replacement of parts associated with conventionally known valvetrain arrangements can be mitigated. Further, a control in various performance metrics of the engine, for example, with delivery of fuel-air charge, combustion of fuel-air charge, and exhaust characteristics can be easily improved with use of embodiments disclosed herein.

While aspects of the present disclosure have been particularly shown and described with reference to the embodiments above, it will be understood by those skilled in the art that various additional embodiments may be contemplated by the modification of the disclosed components and structures without departing from the spirit and scope of what is disclosed. Such embodiments should be understood to fall within the scope of the present disclosure as determined based upon the claims and any equivalents thereof.

What is claimed is:

1. A valvetrain for an engine, the valvetrain comprising:

a pair of valves disposed in a spaced apart relation to one another, each of the valves having an elongated valve stem;

a valve bridge coupled to the pair of valves, the valve bridge configured to define a pair of receptacles to at least partly receive the pair of valve stems therein, the valve bridge further defining a central recess located midway between the pair of receptacles and disposed in a co-planar relationship with the pair of receptacles;

a rocker arm rotatably supported on a rocker shaft and disposed away from the central recess of the valve bridge, the rocker arm having a contact element depending downwardly from an end of the rocker arm, the contact element including an elephant foot button configured to be adjustably supported by the rocker arm, wherein the elephant foot button has a relatively large diameter foot portion and a smaller diameter leg portion disposed between the relatively large diameter foot portion and the rocker arm; and a hydraulic lash adjuster being slidably received in the central recess of the valve bridge, the hydraulic lash adjuster having a sleeve slidably received in the central recess and having a first end of the hydraulic lash adjuster abutting a counterbored face of the valve bridge located adjacent to the central recess, and a plunger slidably received in the sleeve and having a second end of the hydraulic lash adjuster being adapted to operatively abut with the elephant foot button of the contact element of the rocker arm.

2. The valvetrain of claim 1, wherein positioning the central recess midway between the pair of receptacles facilitates an axial abutment of the elephant foot button of the contact element with the second end of the hydraulic lash adjuster such that the valve bridge is configured to simultaneously transmit an equal amount of actuating force from the rocker arm to each of the valves via the axially aligned elephant foot button of the contact element and the hydraulic lash adjuster when the rocker arm operatively executes oscillatory motion about the rocker shaft.

3. The valvetrain of claim 2, wherein the co-planar relationship of the central recess with the pair of receptacles facilitates reciprocal movement of the valve bridge in a longitudinal plane included by the central recess and the pair of receptacles when the rocker arm operatively executes oscillatory motion about the rocker shaft.

4. The valvetrain of claim 3, wherein the co-planar relationship of the central recess with the pair of receptacles is further configured to operatively prevent the valve bridge from tilting and yawing out of the longitudinal plane.

5. The valvetrain of claim 1, wherein the elephant foot button of the contact element defines a first oil passage therethrough, the first oil passage having an outlet located at an end of the elephant foot button of the contact element that is disposed in abutment with the second end of the hydraulic lash adjuster.

6. The valvetrain of claim 5, wherein the plunger of the hydraulic lash adjuster includes a second oil passage having an inlet defined at the second end of the hydraulic lash adjuster.

7. The valvetrain of claim 6, wherein positioning the central recess midway between the pair of receptacles and the co-planar relationship of the central recess midway with the pair of receptacles together facilitate an axial alignment between the outlet of the first oil passage and the inlet of the second oil passage from respective ones of the elephant foot button of the contact element and the plunger of the hydraulic lash adjuster.

8. A valve bridge for a valvetrain having a pair of valves disposed in a spaced apart relation to one another and a rocker arm rotatably supported on a rocker shaft and disposed away from the valve bridge, the rocker arm configured to execute oscillatory motion about the rocker shaft for actuating the pair of valves via the valve bridge, the valve bridge defining:

a pair of receptacles configured to at least partly receive a pair of valve stems therein, the pair of valve stems being associated with the pair of valves; and a central recess located midway between the pair of receptacles and disposed in a co-planar relationship with the pair of receptacles;

wherein the central recess is configured to slidably receive a hydraulic lash adjuster of the valvetrain, the hydraulic lash adjuster being operatively actuated for movement of the valve bridge by the rocker arm via a contact element depending downwardly from an end of the rocker arm, the contact element including an elephant foot button configured to be adjustably supported by the rocker arm; and wherein positioning the central recess midway between the pair of receptacles facilitates the valve bridge to simultaneously transmit an equal amount of actuating force from the rocker arm to each of the valves via the elephant foot button of the contact element and the hydraulic lash adjuster when the rocker arm operatively executes oscillatory motion about the rocker shaft; and wherein the rocker arm includes an extension on the rocker arm selected so as to assist the rocker arm in advantageously maintaining the elephant foot button of the contact element in axial alignment with the hydraulic lash adjuster when the elephant foot button of the contact element abuts the hydraulic lash adjuster during operation of the valvetrain.

9. The valve bridge of claim 8, wherein the pair of receptacles are equidistantly located from the central recess.

10. The valve bridge of claim 8 further comprising a counterbored face located adjacent to the central recess, the counterbored face being configured to abut with a first end of the hydraulic lash adjuster.

11. The valve bridge of claim 8, wherein the co-planar relationship of the central recess with the pair of receptacles facilitates reciprocal movement of the valve bridge in a longitudinal plane included by the central recess and the pair of receptacles when the rocker arm operatively executes oscillatory motion about the rocker shaft.

12. The valve bridge of claim 11, wherein the co-planar relationship of the central recess with the pair of receptacles is further configured to operatively prevent the valve bridge from tilting and yawing out of the longitudinal plane.

13. An engine comprising:

a valvetrain for the engine, the valvetrain comprising:

a pair of valves disposed in a spaced apart relation to one another, each of the valves having an elongated valve stem;

a valve bridge coupled to the pair of valves, the valve bridge configured to define a pair of receptacles to at least partly receive the pair of valve stems therein, the valve bridge further defining a central recess located midway between the pair of receptacles and disposed in a co-planar relationship with the pair of receptacles;

a rocker arm rotatably supported on a rocker shaft and disposed away from the central recess of the valve bridge, the rocker arm having a contact element depending downwardly from an end of the rocker arm, the contact element including an elephant foot button configured to be adjustably supported by the rocker arm; and a hydraulic lash adjuster being slidably received in the central recess of the valve bridge, the hydraulic lash adjuster having a first end being adapted to abut with a counterbored face of the valve bridge located adjacent to the central recess, and a second end being adapted to operatively abut with the elephant foot button of the contact element of the rocker arm, respectively;

wherein positioning the central recess midway between the pair of receptacles and the co-planar relationship of the central recess midway with the pair of receptacles together facilitate an axial alignment between an outlet of a first oil passage and an inlet of a second oil passage defined by respective ones of the elephant foot button of the contact element and the hydraulic lash adjuster, such that the hydraulic lash adjuster is provided with oil when the valves undergo a dwell phase to prevent oscillatory movement of the rocker arm about the rocker shaft and maintain the valves in their closed positions.

* * * * *